US008430029B2

(12) United States Patent
Bohnet et al.

(10) Patent No.: US 8,430,029 B2
(45) Date of Patent: Apr. 30, 2013

(54) INERTIAL DELAY FUSE

(75) Inventors: Michael A. Bohnet, Herndon, VA (US); Yeshayahu S. Goldstein, Gaitherburg, MD (US); Mark H. Machina, Leesburg, VA (US); Kristopher P. Mount, Falls Church, VA (US); Kenneth W. Mitchell, Fredericksburg, VA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 12/023,320

(22) Filed: Jan. 31, 2008

(65) Prior Publication Data

US 2009/0193995 A1 Aug. 6, 2009

(51) Int. Cl.
*F42C 19/06* (2006.01)

(52) U.S. Cl.
USPC ..... 102/216; 102/206

(58) Field of Classification Search ..... 102/216, 102/206
See application file for complete search history.

(56) References Cited

U.S. PATENT DOCUMENTS

| | | | | |
|---|---|---|---|---|
| 2,647,465 | A * | 8/1953 | Rabinow | 102/206 |
| 3,726,036 | A * | 4/1973 | Jennings et al. | 42/105 |
| 4,037,538 | A * | 7/1977 | Andrews et al. | 102/311 |
| 4,216,722 | A * | 8/1980 | Angell | 102/491 |
| 4,245,556 | A * | 1/1981 | Donovan | 102/490 |
| 4,793,259 | A * | 12/1988 | Ambrosi et al. | 102/485 |
| 4,798,139 | A * | 1/1989 | Griffin | 102/216 |
| 5,574,245 | A * | 11/1996 | Buc et al. | 102/485 |
| 6,240,848 | B1 * | 6/2001 | Specht et al. | 102/216 |
| 6,523,478 | B1 * | 2/2003 | Gonzalez et al. | 102/485 |
| 2001/0054365 | A1 * | 12/2001 | Strauss et al. | 102/272 |

* cited by examiner

*Primary Examiner* — Samir Abdosh
(74) *Attorney, Agent, or Firm* — Rossi, Kimms & McDowall; Marc A. Rossi

(57) ABSTRACT

An inertial delay mechanism for use in an explosive projectile is provided. The delay mechanism consists of an inertial delay fuse that is precise, doesn't require sensitive primary explosives and doesn't utilize electronic circuitry. The inertial delay fuse includes a free sliding charge element that strikes an anvil located opposite to the sliding charge element. A delay gap is provided between the sliding charge element and the anvil. Upon impact, the sliding charge element slides forward and impacts the anvil, thereby inducing a shock wave in an initiator charge that subsequently results in detonation of main charges. The design is mechanically simple and robust enough to withstand severe g-loading forces that occur during firing and penetration of a projectile.

14 Claims, 4 Drawing Sheets

INERTIAL DELAY FUSE

STATEMENT OF GOVERNMENT INTEREST

The invention was made with United States Government Support under Contract No. DTRA-99-C-0080 awarded by Defense Threat Reduction Agency and W15Qkn-04-C-1110 awarded by Army Research and Development Command. The United States Government has certain rights in the invention.

BACKGROUND

The invention is directed to providing a delay mechanism for an explosive projectile. In particular, the invention is directed to providing an inertial delay fuse for use in explosive projectiles.

In many explosive projectile applications, such as projectile based drilling or excavation, the detonation of an explosive payload carried by the projectile preferably occurs after the projectile strikes and penetrates the target. The delay in detonating the explosive payload allows the projectile to penetrate into the target a prescribed distance before detonation, thereby allowing a greater amount of material to be excavated as opposed to having the projectile detonate upon impact. Due to the velocity of the fired projectile, the delay in detonation must be short (on the order of tens or hundreds of microseconds) to allow for the delivery of the explosive payload at an appropriate depth within the target.

Conventional chemical delay elements are not precise enough to be utilized for explosive projectile drilling applications. Chemical delay elements generally provide delays on the order of milliseconds with variances on the order of hundreds of microseconds as opposed to tens of microseconds. In addition, very sensitive primary explosives are required when chemical delay elements are used. The use of such sensitive primary explosives for chemical makes the handling and firing of projectiles fitted with chemical delays inherently dangerous.

Electronic delays can also be utilized in projectiles. Electronic delay elements can be very precise and flexible, however, they also require complex and fragile circuitry that is relatively expensive. In addition, electronic delays require that an energy storage device be incorporated into each projectile. Available energy storage devices are relatively bulky and heavy and are not particularly well suited for use in the relatively small projectiles used for excavation. In addition, energy sources may degrade over time causing problems in the reliability of projectiles that have been stored for long periods In view of the above, it would be desirable to provide a delay mechanism that can be readily incorporated into an explosive projectile without requiring very sensitive primary explosives of conventional chemical delay devices or the circuitry of conventional electronic delay devices. Accordingly, such a delay mechanism would be less expensive to manufacture, safer to handle and more reliable.

SUMMARY

The invention provides a delay mechanism for use in an explosive projectile. Specifically, the delay mechanism consists of an inertial delay fuse that is precise, doesn't require sensitive primary explosives and doesn't utilize electronic circuitry. The inertial delay fuse includes a free sliding charge element that strikes an anvil located opposite to the sliding charge element. A delay gap is provided between the sliding charge element and the anvil. Upon impact, the sliding charge element slides forward and impacts the anvil, thereby inducing a shock wave in an initiator charge that subsequently results in detonation of main charges. Alternatively, the anvil can be used to set off a stab detonator. The design is mechanically simple and robust enough to withstand severe g-loading forces that occur during firing and penetration of a projectile.

The sliding charge element preferably includes a cup in which at least one initiator charge pellet is located. In one preferred structure, main charge pellets are also located in the cup such that the main charge pellets form part of the sliding charge element that freely slides forward upon impact of a projectile containing the fuse. In another preferred structure, the cup is retained within a delay tube and the main charge pellets are located around the delay tube such that only initiator charge pellets form part of the freely sliding charge element.

In the case of use of the delay tube, the delay tube preferably includes openings adjacent to the anvil. Detonation of the main charges is accomplished through the use of a flyer-plate mechanism, in which portions of the cup pass through the openings of the delay tube to strike an explosive lead charge pellet.

In an alternative embodiment, the cup includes an opening and the anvil includes a projection that fits into the opening provided in the cup. The cup moves forward upon impact causing the projection to pass through the opening and strike a conventional stab detonator such as an M55 Detonator.

An inner surface of the cup is preferably shaped to focus a shock wave into the initiator charge. For example, a concave portion is formed on the inner surface of the cup that faces the initiator charge.

BRIEF DESCRIPTION OF THE DRAWINGS

The invention will be described with reference to certain preferred embodiments thereof and the accompanying drawings, wherein.

DETAILED DESCRIPTION OF THE PREFERRED EMBODIMENTS

Figure 1:
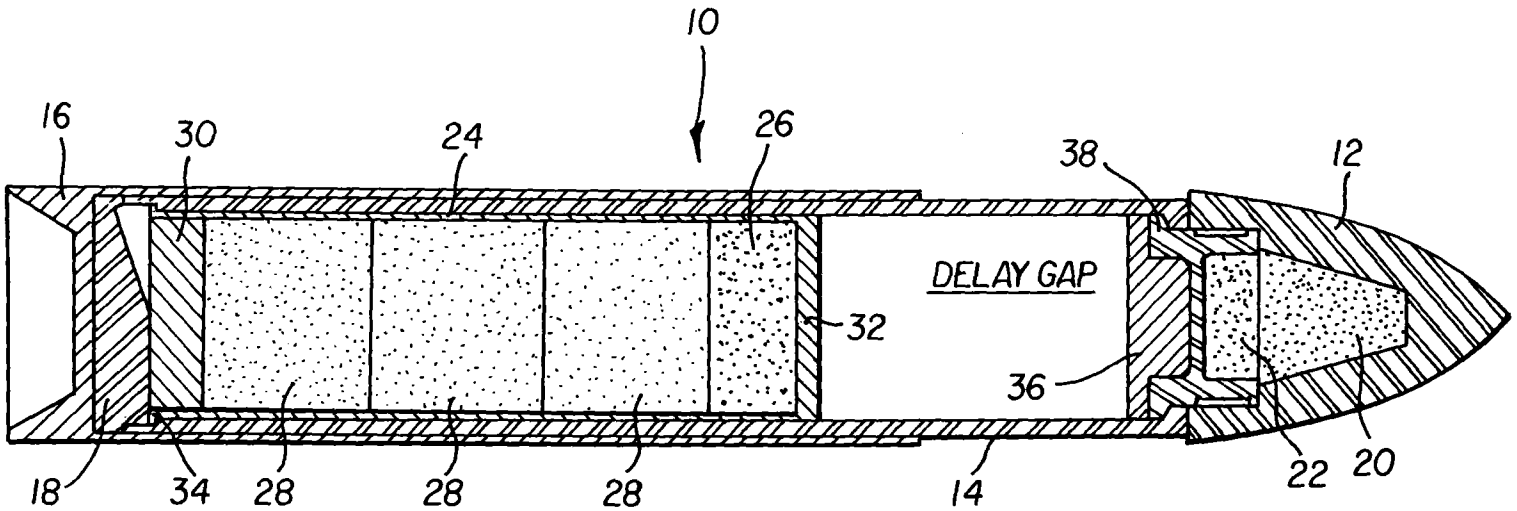
FIG. 1 is a cross-sectional view of a projectile incorporating an inertial fuse in accordance with a first embodiment of the invention.

An explosive projectile 10 incorporating an inertial delay fuse in accordance with a first embodiment of the invention is shown in FIG. 1. The projectile 10 includes a penetrating nose cone 12, a casing 14, a sabot 16 and a pusher plate 18 that allows for acceleration in a gun bore. A nose charge 20 and a nose charge initiator 22 are provided within the nose cone 12. A sliding main charge element 24 is provided within the casing 14. The sliding main charge element 24 includes an initiator charge pellet 26 (PETN), several main charge pellets 28 (Pax-11) and a tamper 30 that are located within a sliding cup 32 (preferably 7075 aluminum). The sliding main charge element 24 is placed at the rear of the projectile 10 such that a machined tab 34 of the sliding cup 32 is retained by an edge of the casing 14. The tab 34 holds the sliding cup 32 in a fixed position until the projectile 10 impacts a target. At that point, the tab 34 breaks and allows the sliding cup 32 to slide forward as will be described in greater detail below. An anvil 36 made of a dense material (for example HD 18.5 Tungsten Alloy) is placed at the front of the projectile 10 adjacent to the nose cone 12, such that a delay gap is provided between a front face of the sliding cup 32 and a face of the anvil 36. The anvil 36 is screwed into a coupler 38, which is also threaded to accept and hold the nose cone 12 to the casing 14. In the above-described configuration, the projectile 10 essentially consists of two primary masses, namely, the sliding main charge element 24 and the penetrating nose cone 12, which are accelerated together when fired from the bore of a gun.

In operation, the nose cone 12 is slowed down by forces transferred to the nose cone 12 when the projectile 10 strikes a target. The sliding main charge element 24, however, essentially retains its velocity, as the tab 34 of the sliding cup 32 breaks free from the casing 14 due to the large applied forces, thereby allowing the sliding main charge element 24 to slide freely toward the anvil 36 through the delay gap. The sliding main charge element 24 builds forward velocity relative to the decelerating nose block 12 as it passes through the delay gap. After a predetermined period defined, in part, by the length of the delay gap, the sliding cap 32 strikes the anvil 36 and a high pressure shock wave is created that propagates back through the sliding cap 32 and into the initiator charge pellet 26, where the shock wave runs up to a detonation wave. The detonation wave transfers into the main charge pellets 28 located adjacent to the initiator charge pellet 26 causing full detonation of the sliding main charge element 24. The tamper 30 (preferably made of Copper) is provided to add mass and increase the time at pressure as the sliding main charge element 24 detonates. The high pressure resulting from the detonation of the sliding main charge element 24 in turn launches a shock wave in the forward direction that propagates back through the anvil 36, the coupler 38 and into the nose charge initiator 22. The shock wave runs up to a detonation wave in the initiator charge 22 causing the nose charge 20 to detonate and thereby fracture the nose cone 12.

As will be readily appreciated by those skilled in the art, the delay in detonation can be precisely set by changing factors including, but not limited to, the length of the delay gap, the total projectile mass, the mass of the sliding main charge 24, the shape of the nose cone 12, and the strike velocity. Accordingly, the delay time between impact and detonation can be precisely controlled on the order of microseconds to compensate for weak or strong targets, desired depth of penetration, etc. using a very simple and robust mechanical structure. Accordingly, the deficiencies of conventional chemical and electrical fuses can be avoided.

Figure 2:
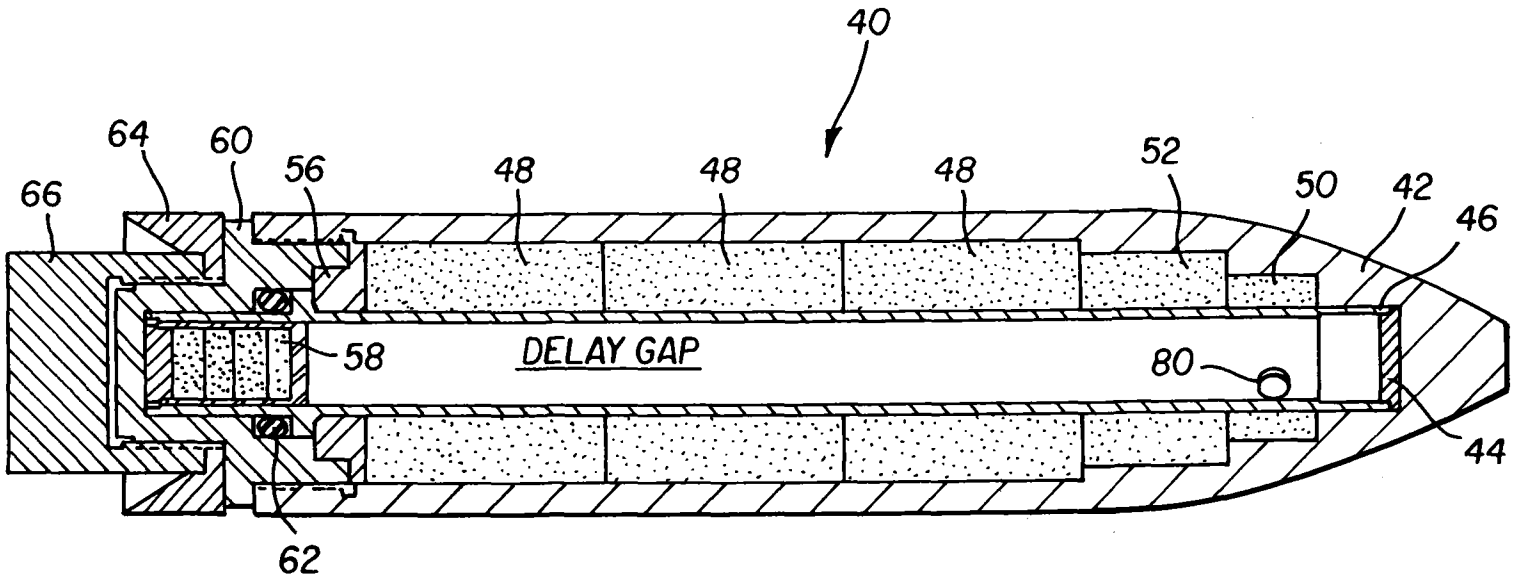
FIG. 2 is a cross-sectional view of a projectile incorporating an inertial fuse in accordance with a second embodiment of the invention.

A second embodiment of the invention will now be described with reference to FIG. 2. The second embodiment primarily differs from the first embodiment in that only a sliding initiator charge element is used instead of a sliding main charge element. As shown in FIG. 2, an explosive projectile 40 is shown that includes a casing 42, an anvil 44 located in the front of the casing 42, a delay tube 46 fitted along a central axis of the casing 42, several main charge pellets 48 (for example PAX-11) that surround the delay tube 46, a first stage nose pellet 50 and second stage nose pellet 52 (for example PBX-9407), a base plate 56, a sliding initiator charge element 58, an end cap 60 that screws into the casing 42, a sealing O-ring 62, a sabot 64 and a sabot retainer 66.

Figure 3:
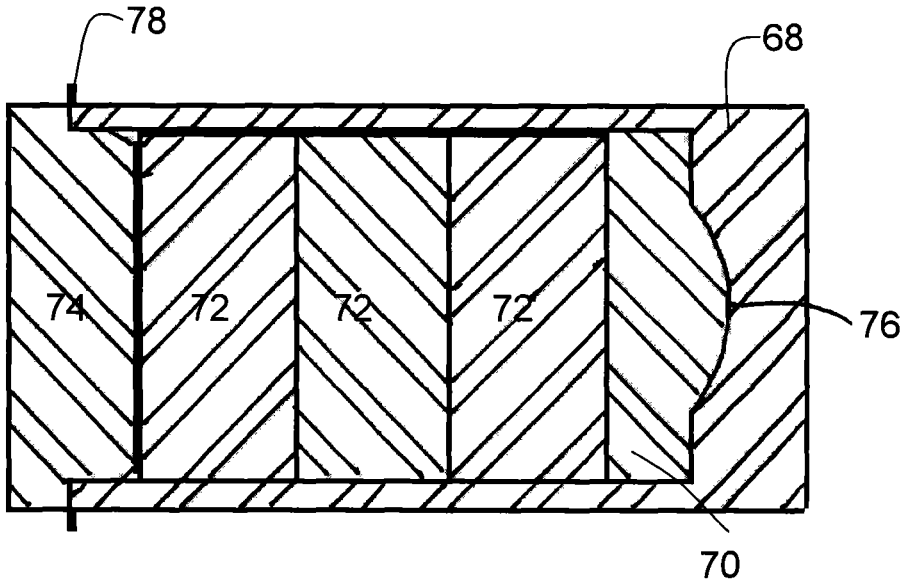
FIG. 3 is a cross-sectional view of a preferred cup structure used in the embodiment of FIG. 2.

As shown in FIG. 3, the sliding initiator charge element 58 includes a sliding cup 68, preferably manufactured from AZ31B Magnesium, which retains a first stage initiator charge pellet 70 (PETN), several second stage initiator charge pellets 72 (PETN) and a hammer element 74 (preferably Tungsten). The sliding cup 68, as in the first embodiment, also includes a tab 76 that is used to hold the sliding initiator charge element 58 in place until the projectile 40 impacts a target. In the illustrated embodiment, the tab 76 is a machined circular lip that extends around the entire circumference of the end of the sliding cup 68. The tab 76, however, may be formed of one or more tab elements instead of a single circular lip. An inner surface of the sliding cup 68 also preferably includes a concave portion 76 that focuses a shock wave into the first stage initiator charge pellet 70 as will be described in greater detail below.

As in the case of the first embodiment, the second embodiment uses the built up velocity difference between the penetrating nose of the casing 42 and the sliding initiator charge element 58, caused by the impact of the projectile 40 on a target, to both delay and initiate the explosive train. Unlike the first embodiment, however, the main charge pellets 48 are separated from the sliding cup 68 such that the main charge pellets 48 do not move. Instead, only the first and second stage initiator charge pellets 70, 72 contained within the sliding cup 68 move down the delay tube 46 and pass through the delay gap. After a predetermined time period determined, in part, by the length of the delay gap between the initial location of the sliding cup 68 and the anvil 44, the sliding cup 68 strikes the anvil 44 causing a shock wave to travel rearward into the first initiator charge pellet 70. The shock wave subsequently runs up to a detonation wave and is transferred to the second initiator charge pellet 72. The detonation wave is preferably transferred to the first and second stage nose charge pellets 50, 52 through a flyer-plate initiation mechanism. Specifically, portions of the sliding cup 68 are blown outward in the radial direction into transfer holes 80 provided in the delay tube 46. The fragmented portions of the sliding cup 68 act as mini flyer-plates that impact the first stage nose charge pellet 50 causing it to run up to detonation. Detonation then propagates through the second stage nose charge pellet 52 and into the main charge pellets 48. Delay time can be adjusted in the same manner as in the first embodiment. As shown in the illustrated embodiments, the end of the delay tube 46 is preferably expanded in diameter to provide a volume to mitigate the gas pressure buildup.

In this embodiment, the hammer 74 performs a function similar to the tamper 30 of the first embodiment, by increasing the time at pressure when the sliding initiator charge element 58 detonates. The length of the sliding initiator charge element 58 is preferably adjusted such that the hammer 74 ends up in a location adjacent to the transfer holes 80, such that the mass of the hammer 74 assists in directing the detonation shock wave to push the fragments of the sliding cup 68 through the transfer holes 80. It is preferable that the mass of the hammer 74 be greater than the combined mass of the other elements of the sliding initiator charge element 58. The increased mass of the hammer 74 provides a benefit in that the tab 78 of the sliding cup 68 can be made of a thickness (for example four thousands of an inch) that is easily machined. Without the heavy hammer 74, the tab 78 would have to be much thinner (for example two thousands of an inch) to insure breakage upon impact of the projectile 40 on a target.

The provision of the delay gap in "parallel" with the main charge in the second embodiment of FIG. 2 rather than in "series" as provided in the first embodiment of FIG. 1, allows both for a shorter projectile and a longer delay gap while minimizing fuse volume. A shorter projectile translates into a lighter projectile and a shorter cartridge, while a longer delay gap translates into a higher slapping velocity and consequently a more reliable functioning of the initiator. The need for a nose charge is also eliminated in the embodiment of FIG. 2, as the first and second stage nose charge pellets 50, 52 also serve to break up the nose of the projectile 40. Another benefit of the "parallel" delay gap configuration is a lower strike velocity to deliver the main charge to a given depth in a target. In contrast, the "series" delay gap of the first embodiment serves to reduce the deceleration pressure in the main charge during penetration because the main charge is free to slide. Thus, a more shock sensitive explosive can be utilized in the main charge of the first embodiment.

Figure 4:
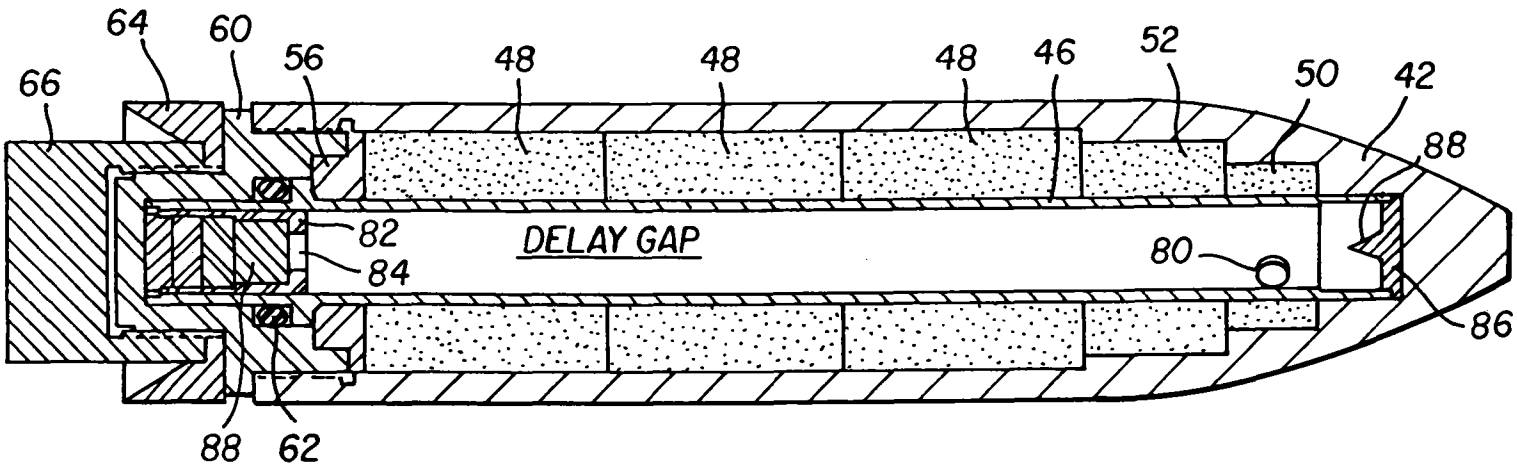
FIG. 4 is a cross-sectional view of a projectile incorporating an inertial fuse in accordance with a third embodiment of the invention.

FIG. 4 illustrates a modification of the projectile 40 illustrated in FIG. 2. Like components are indicated with the same reference numerals. In the third embodiment illustrated in FIG. 4, a modified cup 82 is provided with an opening 84. In this case, a modified anvil 86 is provided with a needle like projection 88 that passes through the opening 84 in the modified cup 82 and strikes a conventional military grade stab detonator 88 (preferably an M55 detonator). Accordingly, detonation is initiated through the use of a stab detonator instead of inducing a shock wave into an initiator charge as in the embodiments illustrated in FIGS. 1 and 2.

The invention has been described with reference to certain preferred embodiments thereof. It will be understood, however, that modifications and variations are possible within the scope of the appended claims. For example, while the embodiment of FIG. 1 preferably includes the use of a nose cone charge to fragment the nose cone. While the fragmentation of the nose cone is desirable in excavation applications, it may not be necessary in other projectile applications. Accordingly, the nose cone charge can be eliminated if not required for a particular application. Further, the number of main and initiator charge pellets may be varied depending on the required application. In addition, while the use of the tamper 30 and hammer 74 are preferable, these elements may also be eliminated depending on the particular application. Still further, the structural configuration of the illustrated components may also be varied as long as the concept of using mechanical inertia to cause detonation is employed.

What is claimed is:

1. An inertial delay fuse comprising:

a delay tube;

a main charge located adjacent to an outside surface of the delay tube;

a sliding charge element located within the delay tube and including a cup and an initiator charge located within the cup, said cup including at least two side walls and an end wall; and an anvil located opposite to and spaced apart from the sliding charge element;

wherein the sliding charge element is initially located at a first end of the delay tube and the anvil is located at a second end of the delay tube opposite the first end, thereby defining a delay gap between the sliding charge element and the anvil consisting essentially of an empty space;

wherein the sliding charge element is moveable within the empty space to strike the anvil upon activation of the inertial delay fuse; and wherein a length of the delay tube determines a delay time for the inertial delay fuse.

2. An inertial delay fuse as claimed in claim 1, wherein the cup includes an opening in the end wall which faces the anvil and the anvil includes a projection that fits into the opening provided in the cup.

3. An inertial delay fuse as claimed in claim 1, wherein an inner surface of the end wall of the cup is shaped to focus a shock wave into the initiator charge.

4. An inertial delay fuse as claimed in claim 3, wherein the inner surface of the end wall of the cup includes a concave portion.

5. A projectile comprising:

a casing; and an inertial delay fuse located within the casing;

wherein the inertial delay fuse includes:

a delay tube located;

a main charge located between the delay tube and the casing;

a sliding charge element locating within the delay tube and including a cup and an initiator charge located within the cup, said cup including at least two side walls and an end wall; and an anvil located opposite to and spaced apart from the sliding charge element;

wherein the sliding charge element is initially located at a first end of the delay tube and the anvil is located at a second end of the delay tube opposite the first end, thereby defining a delay gap between the sliding charge element and the anvil consisting essentially of an empty space;

wherein the sliding charge element is moveable within the empty space to strike the anvil upon activation of the inertial delay fuse; and wherein a length of the delay tube determines a delay time for the inertial delay fuse.

6. A projectile as claimed in claim 5, wherein the cup includes an opening and the anvil includes a projection that fits into the opening provided in the cup.

7. A projectile as claimed in claim 5, further comprising a nose cone coupled to the casing, wherein the nose cone includes a nose cone main charge and a nose cone initiator charge.

8. A projectile as claimed in claim 7, further comprising a buffer plate located between the nose cone initiator charge and the anvil.

9. A projectile as claimed in claim 5, further comprising at least one main initiator charge located adjacent to openings provided in the second end of the delay tube.

10. A projectile as claimed in claim 9, further comprising at least one main charge located adjacent to the main initiator charge and surrounding the delay tube.

11. A projectile as claimed in claim 6, further comprising at least one main initiator charge located adjacent to openings provided in the second end of the delay tube.

12. A projectile as claimed in claim 11, further comprising at least one main charge located adjacent to the main initiator charge and surrounding the delay tube.

13. A projectile as claimed in claim 8, wherein an inner surface of the cup is shaped to focus a shock wave into the initiator charge.

14. A projectile as claimed in claim 13, wherein the inner surface of the cup includes a concave portion.

* * * * *